US006539687B1

(12) United States Patent
Keen et al.

(10) Patent No.: US 6,539,687 B1
(45) Date of Patent: Apr. 1, 2003

(54) MODULAR WRAPPING APPARATUS

(75) Inventors: Bruce W. Keen, Chattanooga, TN (US); Ira Greene, Birchwood, TN (US)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 09/615,901

(22) Filed: Jul. 13, 2000

(51) Int. Cl.[7] ..... B65B 11/14

(52) U.S. Cl. ..... 53/201; 53/227; 53/370; 53/547

(58) Field of Search ..... 53/201, 227, 370, 53/547

(56) References Cited

U.S. PATENT DOCUMENTS

| | | | | | |
|---|---|---|---|---|---|
| 2,744,370 | A | * | 5/1956 | Seragnoli | 53/370 |
| 3,001,351 | A | * | 9/1961 | Brook et al. | 53/547 |
| 3,131,522 | A | * | 5/1964 | Latini et al. | 53/370 |
| 3,342,015 | A | * | 9/1967 | Kawasaki | 53/370 |
| 3,968,627 | A | * | 7/1976 | Seragnoli | 53/370 |
| 4,102,111 | A | | 7/1978 | Nack et al. | 53/182 R |
| 4,429,513 | A | * | 2/1984 | Beckers et al. | 53/547 |
| 5,490,368 | A | | 2/1996 | Spatafora | 53/234 |
| 5,694,745 | A | * | 12/1997 | Spatafora et al. | 53/547 |

FOREIGN PATENT DOCUMENTS

| | | | | |
|---|---|---|---|---|
| EP | 0 733 548 A1 | | 9/1996 | |
| GB | 0 409 013 | | 4/1934 | |
| GB | 0 901 339 | | 7/1962 | |
| GB | 2066202 A | * | 7/1981 | 53/370 |
| GB | 2 220 187 A | | 1/1990 | |
| JP | 56-023407 | | 3/1981 | |

* cited by examiner

*Primary Examiner*—John Sipos
(74) *Attorney, Agent, or Firm*—Fitzpatrick, Cella, Harper & Scinto

(57) ABSTRACT

A modular apparatus is provided for the purpose of packaging an article in a special wrap (such as a single or double twist wrap, an envelope wrap, a bunch wrap, or other special wrap). The modular apparatus has a receiving portion, arranged to receive a partially-wrapped article (such as a tube-wrapped article) into a predetermined location, from another machine, and a special-wrap assembly that forms the desired special wrap. For a double twist-wrap, the special-wrap assembly has rotatable twist grippers that grip the ends of the tube-wrapped article, and twist the ends to form a twist-wrapped article, and includes a twist-wrap drum and Geneva wheels that drive the twist grippers. The modular apparatus is used with a flow-wrap packaging line for wrapping a series of individual articles, which has a first section, in which a film is formed into a tubular wrap about the articles, and a cut-and-seal section, in which the tubular wrap is cut between each two successive articles. The modular apparatus may be detachable from the flow-wrap line but in any A event is capable of being deactivated to permit use of the flow-wrap packaging line without the special wrap.

8 Claims, 17 Drawing Sheets

MODULAR WRAPPING APPARATUS

BACKGROUND OF THE INVENTION

1. Field of the Invention

The present invention relates generally to apparatus and methods for wrapping articles, and relates more particularly to such apparatus and methods useful for wrapping articles such as candy bars or other food products in a manner incorporating a wrap such as a single or double twist-wrap, an envelope wrap, a bunch wrap or a modified envelope wrap. The invention is applicable to wrapping performed with either a heat sealing method or a cold-seal adhesive.

2. Related Background Art

The great majority of candy bars are packaged by being wrapped and sealed in a film of wrapping material, on which is printed the desired package artwork, logos, etc. Such wraps are generally formed in the following way. A continuous film of the wrapping material is printed with the artwork and the like (this is generally done by the vendor of the film, not by the food packager). In the actual packaging process, the products are deposited in the film with proper registration, so that the individual products line up with the artwork on the film. The film is wrapped around the products 12 and sealed in a continuous seam 14 to form a tubular shape 16 (see FIG. 2). This tube 16 is then cut into parts at the correct locations to produce individual tubular lengths of film, each containing one product. Both ends of each of these are then sealed by heat sealing methods or cold-seal adhesive, completing the formation of the familiar wrapped product 20 (see FIG. 1). Commonly, the cutting and the sealing are performed simultaneously, by a mechanism known as a cut-and-seal. These techniques are referred to herein as the conventional "flow-wrap" process.

Another form of wrap for food products, such as candies, involves wrapping individual pieces of the product in a film that is wrapped around the product, again in a tubular fashion, with a twist in each end (see 30, in FIG. 3). Small hard candies wrapped in this manner are also a familiar product. (In contrast to this double twist-wrap, various other twist-wrap techniques are used for other products, such as lollipops. Other types of wrapping techniques useful for various food products are the envelope wrap, the bunch wrap and the modified envelope wrap. These wrapping techniques are well understood by those of ordinary skill in the art, and together with the double twist-wrap will be termed "special wraps" or "special wrapping techniques" herein.)

It would be desirable to provide an apparatus and a method capable of wrapping products, such as candy bars, with a double twist-wrap. It would be especially desirable to provide a modular apparatus that could be used with a standard continuous flow-wrap line of the type used for wrapping candy bars, so that the continuous flow-wrap line could be used as desired either to turn out double twist-wrapped product 30, or product wrapped in the familiar packaging 20 with both ends of the wrap sealed in a flat shape.

In addition, it would be desirable to provide a modular apparatus that could be used with a standard continuous flow-wrap line of the type used for wrapping candy bars with one or another of the special wrapping techniques mentioned above, including bunch wrap, single twist wrap, envelope wrap, and modified envelope wrap, such that the continuous flow-wrap line could be used as desired either to turn out product wrapped using such special wrap, or product wrapped in the familiar packaging with both ends of the wrap sealed in a flat shape.

SUMMARY OF THE INVENTION

Accordingly, it is one object of the invention to provide an apparatus that enables one to form such a double twist-wrap packaging for articles reliably and at a high speed.

It is another object of the invention to provide such an apparatus that can be attached to a flow-wrap line for twist-wrapping (or other special wrapping), and can be deactivated when the line is to be used for standard continuous-flow wrapping.

It is still another object of the invention to provide a double twist-wrap apparatus having a twist-wrap mechanism that effects the twist-wrap reliably, and which is actuated only when necessary for that purpose, and which is deactivated between the end of formation of one twist-wrap and the beginning of the formation of another twist-wrap by the mechanism.

According to the present invention, these objects are achieved by providing a modular special-wrap apparatus that has a receiving portion, arranged to receive a partially-wrapped article, for example a tube-wrapped article, into a predetermined location, from another machine, and a special-wrap assembly that forms the desired special wrap. For a double twist-wrap, the special-wrap assembly has rotatable twist grippers to grip the ends of the partially-wrapped article, and to twist the ends to form a twist-wrapped article.

According to another aspect of the present invention, these objects are achieved by providing a flow-wrap packaging line for wrapping a series of individual articles, which has a first section, in which a film is formed into a tubular wrap about the articles, a cut-and-seal section, in which the tubular wrap is cut between each two successive articles, and a twist-wrap or other special-wrap section, which may be detachable but in any event is capable of being deactivated to permit use of the flow-wrap packaging line without the special wrap. The cut-and-seal section is operable in a first mode, in which the tubular wrap is also sealed, thereby completing wrapping of the articles, and in a second mode, in which the tubular wrap is cut but not sealed. The special-wrap section has a receiving portion, arranged to receive a tube-wrapped article into a predetermined location, from another machine (i.e., the cut-and-seal section), and a portion that forms the desired special wrap. In the case of a twist-wrap, the special-wrap section has rotatable grippers to grip ends of the tube-wrapped article, and to twist the ends to form a twist-wrapped article.

According to another aspect of the invention, these objects are attained by providing a twist wrap apparatus that has a receiving portion, arranged to receive a tube-wrapped article into a predetermined location, from another machine, and a twist-wrap assembly. The twist-wrap assembly has rotatable twist grippers to grip ends of the tube-wrapped article and to twist the ends to form a twist-wrapped article, and includes a twist-wrap drum and Geneva wheels that drive the twist grippers.

Other features and advantages of the present invention will be more fully understood from a consideration of the following detailed description of the preferred embodiment, taken in conjunction with the accompanying drawings.

BRIEF DESCRIPTION OF THE FIGURES

FIG. 7 illustrates the transfer of an article to the preferred embodiment from the cut-and-seal device, FIGS. 8–10 show the rotation of the articles on the first drum, and FIG. 13 shows the transfer of the twist-wrapped article from the second drum to the third drum of the preferred embodiment.

DETAILED DESCRIPTION OF THE PREFERRED EMBODIMENT

Figure 4:
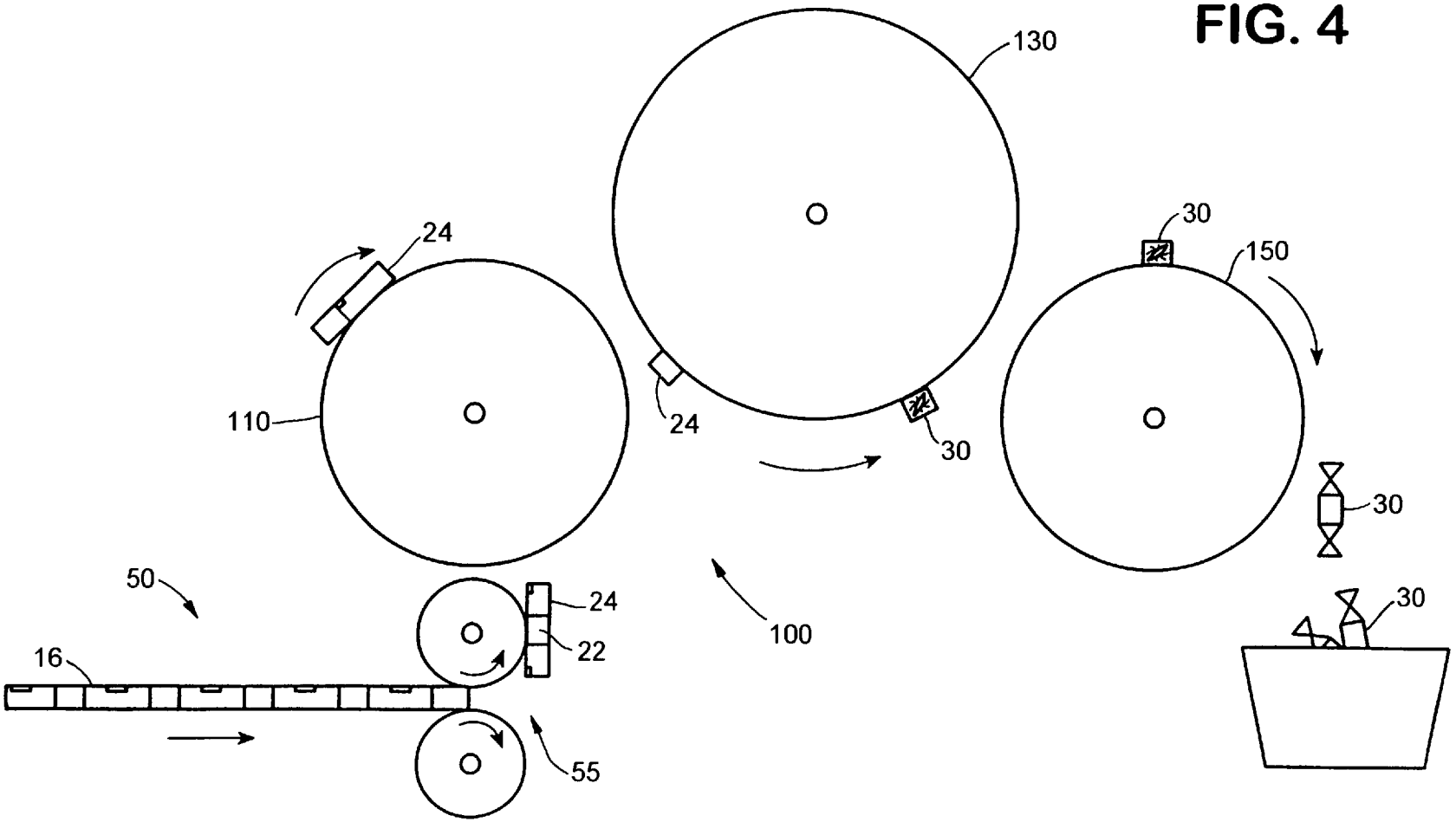
FIG. 4 is a schematic view illustrating a twist-wrap apparatus according to the preferred embodiment of the invention, attached to a conventional continuous-flow-wrap packaging line.

FIG. 4 shows, schematically, the preferred embodiment of the present invention, a modular twist-wrap apparatus 100 together with a conventional continuous flow-wrap packaging line 50 (only a portion of which is shown). The conventional line, being well known, will not be described or illustrated in any detail, and by itself, it does not form part of the present invention (although the combination of the conventional packaging line with the modular apparatus claimed herein, is within the scope of the invention).

Figure 1:
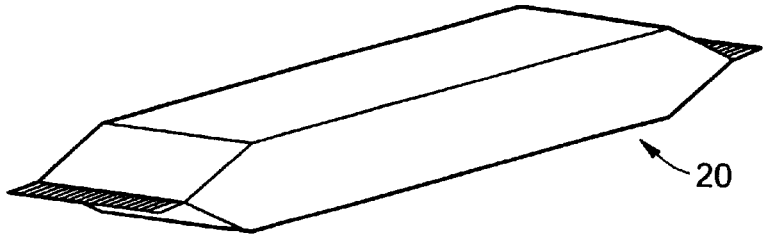
FIG. 1 PRIOR ART
FIG. 1 is a view of a product wrapped by a conventional continuous-flow-wrap packaging line like that shown in part in FIG. 4.
Figure 2:
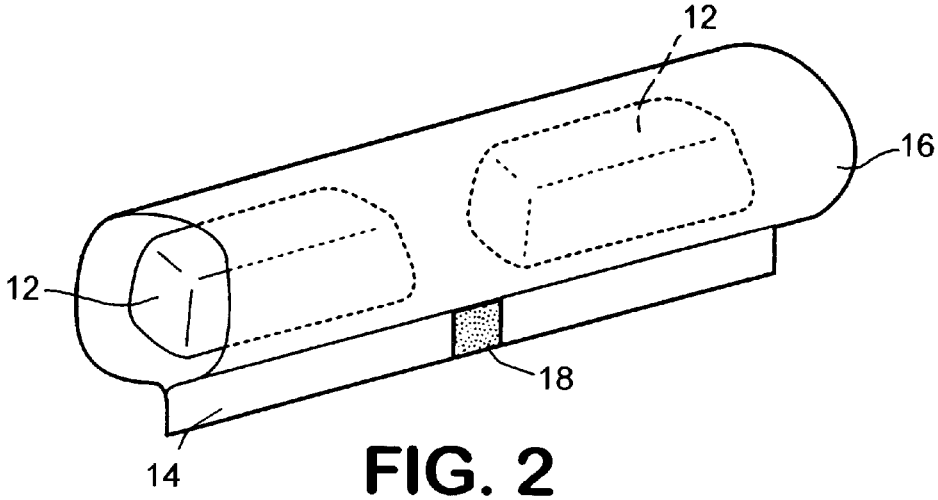
FIG. 2 PRIOR ART
FIG. 2 shows two articles of a product in a sheet of film wrap that has been folded around the product, and seamed, to form a tubular shape containing the product, prior to the cutting and sealing of the individual packages in conventional flow-wrap processing.
Figure 3:
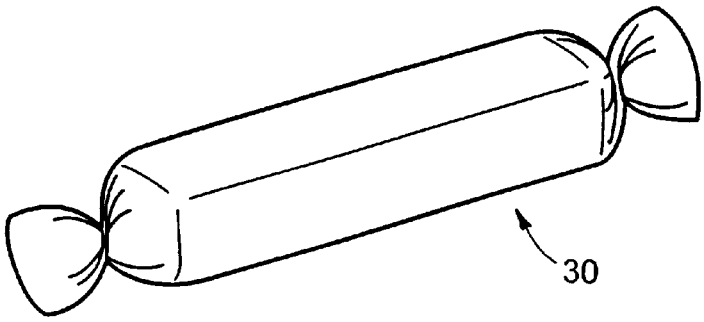
FIG. 3 shows a product wrapped using the twist-wrap apparatus of the present invention.

FIG. 1 illustrates the well-known form of candy bar wrapping 20 obtained with the conventional type of continuous flow-wrapping packaging process. In the conventional process, the products 12 being wrapped are placed on a continuous film of known composition, which is usually preprinted with artwork, logos, product name, etc. The side edges of the film are brought together and welded or glued to produce a seam 14, thus forming a tubular shape 16 containing the articles 12 being packaged, as illustrated in FIG. 2. In the conventional processing, the tubular shape is then divided into portions each containing one product, and the ends of each portion are welded or glued shut, thus producing the form shown in FIG. 1. These conventional processing steps, like the apparatus used to perform them, are well known in the art and will not be described in greater detail.

When the modular twist-wrap apparatus 100 of the preferred embodiment is attached to and used with the standard continuous flow-wrap line 50, the operation of the latter is modified in certain respects. First, since it is desired to form a twist-wrap rather than a flat seam at each end of the package, the placement of adhesive on the film must be adjusted accordingly (the twists that are formed at the ends of the package may be secured in any fashion that proves effective, including the use of either heat-seal or a cold adhesive). Second, the cut-and-seal 55 (the component of the standard continuous flow-wrap line that cuts the tubular shape 16 shown in FIG. 2 into individual portions and then seals the ends), is set only to perform the cutting, and does not seal the ends of the individual packages. Third, the registration and the encoder signals used in the control of the standard line are supplied to the modular twist-wrap apparatus. According to the preferred embodiment, these are the only control signals that need to be supplied to the modular twist-wrap apparatus from the standard line.

Overview of the Functions of the Modular Twist-Wrap Apparatus

The modular twist-wrap apparatus 100 receives the tubular products, in their individual "product wraps" 24 (i.e., a segment cut from tube 16 and containing the product 22 to be packaged in a single package), from the upper arbor 57 of the cut-and-seal 55. Three drums 110, 130 and 150 are provided in the twist-wrap apparatus, and perform the following operations on the products.

Figure 5:
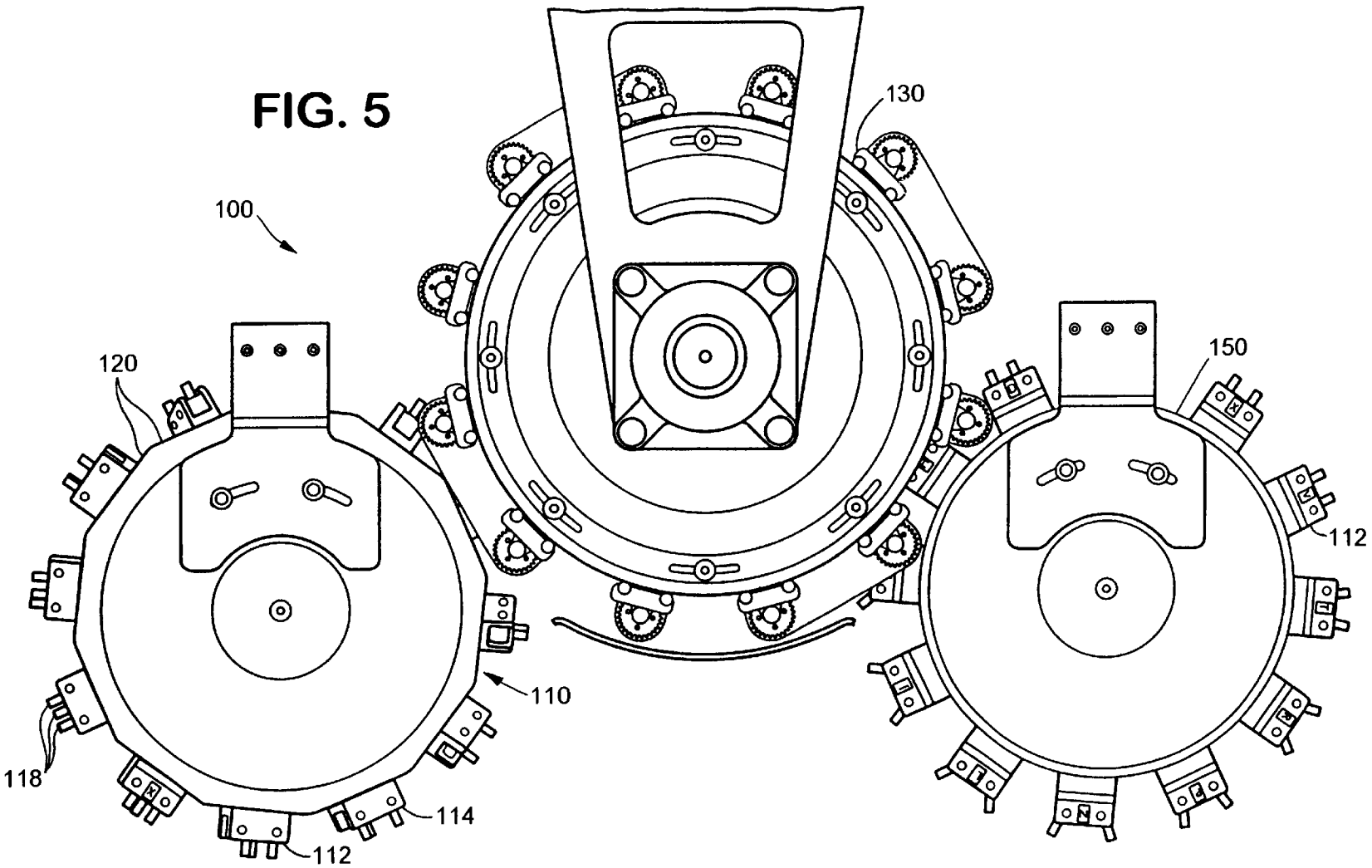
FIG. 5 is a front view of the modular twist-wrap apparatus according to the preferred embodiment.
Figure 8:
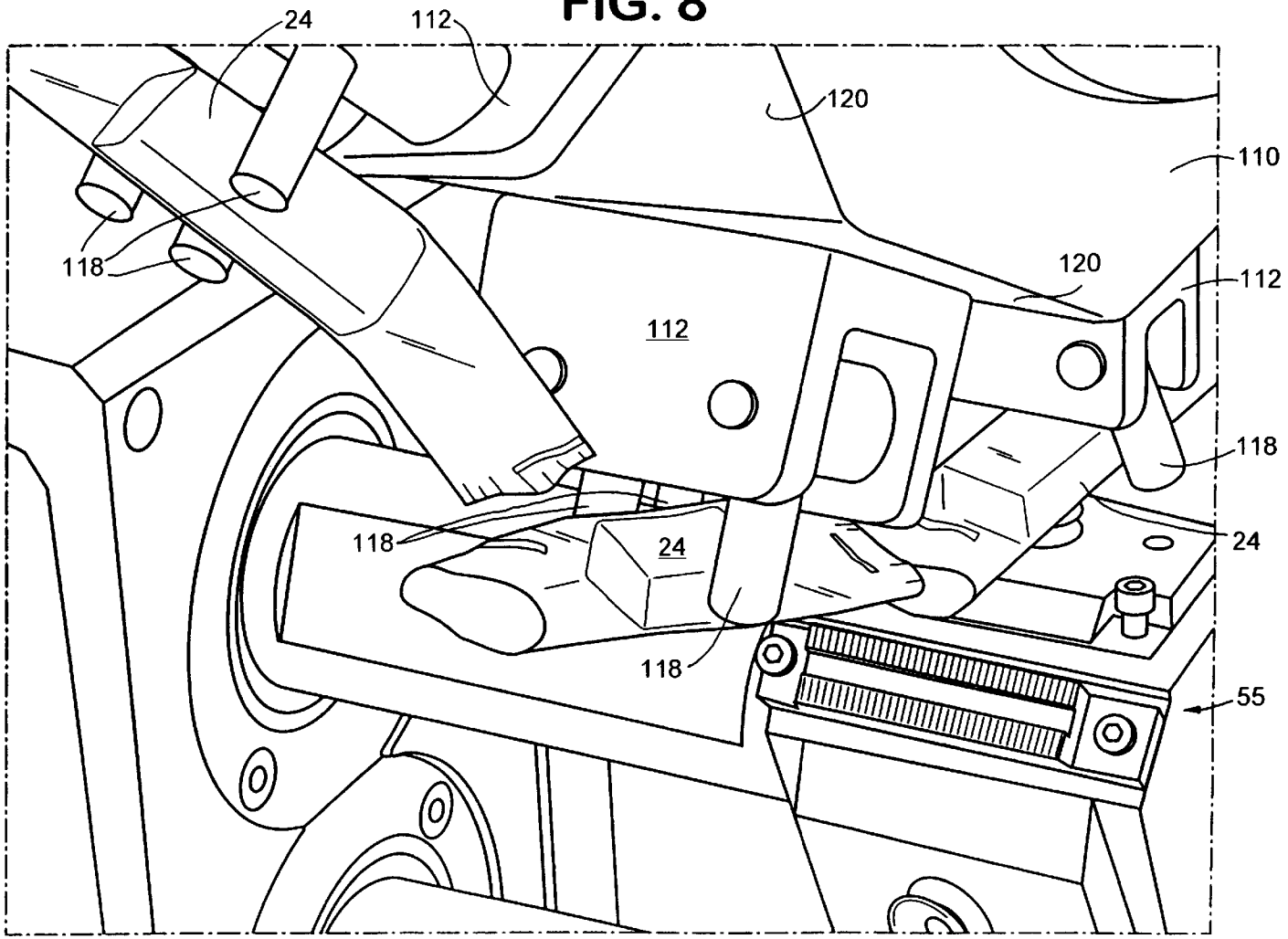
Figure 9:
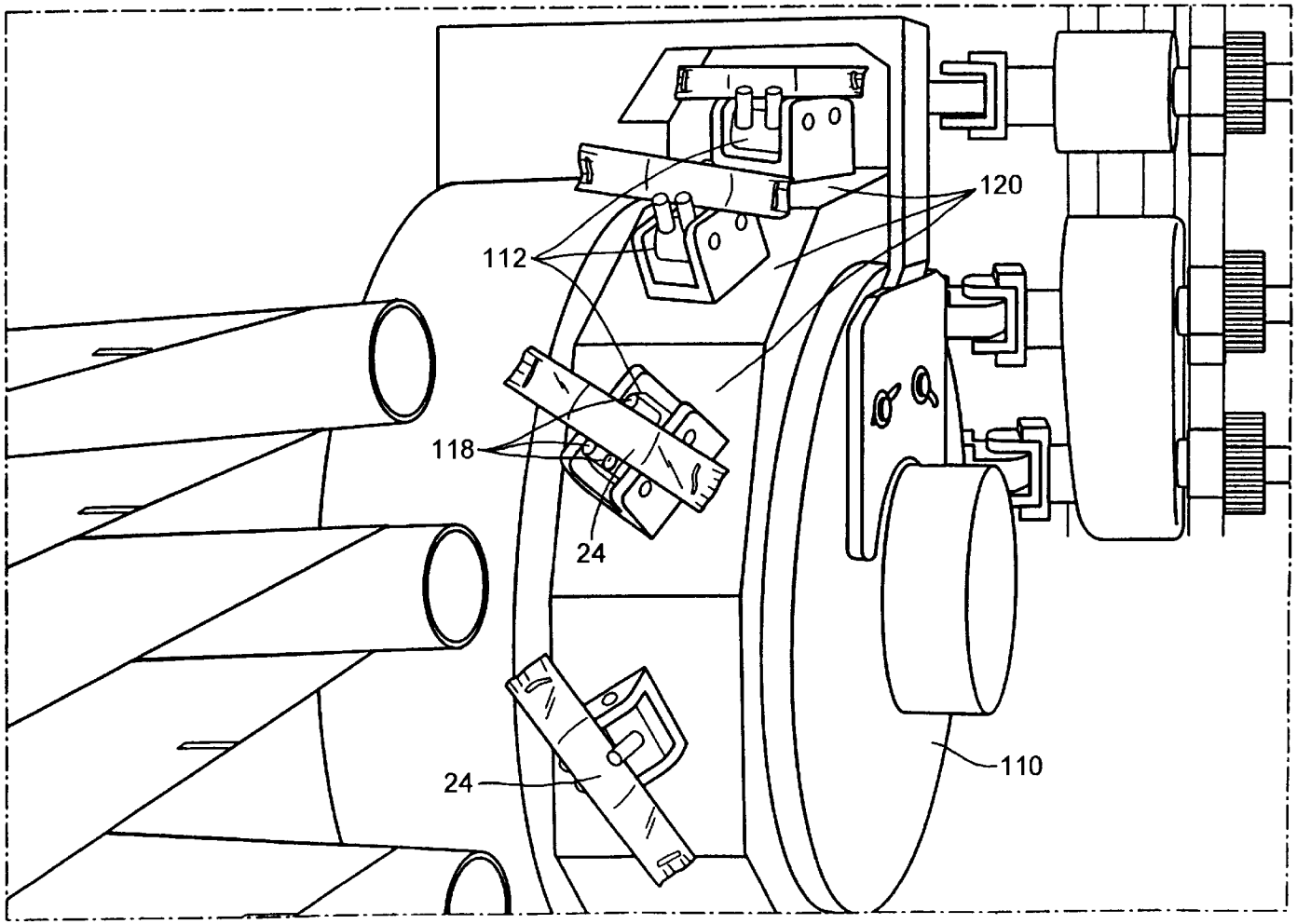

The first drum 110 is a transfer-and-rotate drum (see also FIGS. 5 and 9), which receives the product 24 from the cut-and-seal 55 into a product gripper 112 (FIG. 5). While the product 24 is transported to the second drum 130 by rotation of the transfer-and-rotate drum 110, the product gripper 112 itself is rotated to re-orient the product by 90° (see FIGS. 8 and 9). As a result, the product 24 is delivered to the second drum 130 in an orientation with the open ends of the product's "wrap" extending in a line parallel to the axis of rotation of the second drum (this is indicated schematically in FIG. 4, where product 24 is viewed from the side while in the cut-and-seal, is rotating on the first drum 110, and is seen end-on while on drum 130).

The second drum 130 is where the actual twist-wrap formation is performed. For this purpose, the product 24, held by a product gripper 112 (like those on the transfer-and-rotate drum 110), is gripped at each end by twist grippers 132 (see FIG. 6), which are timed to close on the "tube" once the product is securely received by the product gripper 112 on the twist-wrap drum 130. The twist grippers 132 are then rotated about their own axis (parallel to the axis of drum 130) through an angle of 720° while the twist-wrap drum 130 is itself rotating. The force applied in this fashion twists the ends of the "tube" into the desired twist-wrap shape, and the adhesive seals the package. The twist grippers 132 are then opened, and the product 30 ("30" rather than "24" because it is now twist-wrapped) is transferred to the third drum 150, the discharge drum.

The discharge drum 150 has the function of receiving the packaged product 30 from the twist-wrap drum 130, delivering the product to the desired discharge point, and discharging it in an orderly fashion.

The Transfer-and-Rotate Drum

Figure 10:
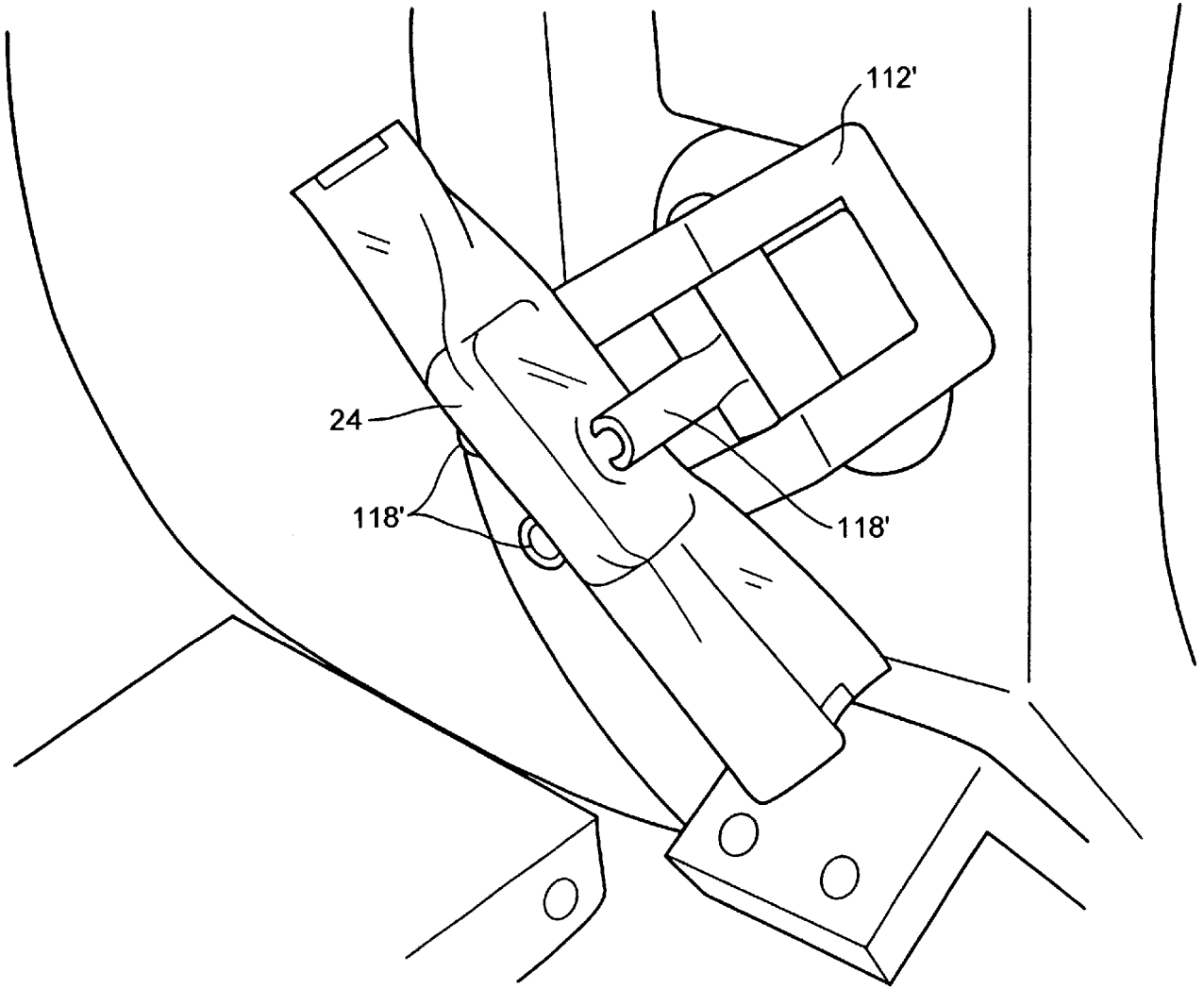
Figure 11:
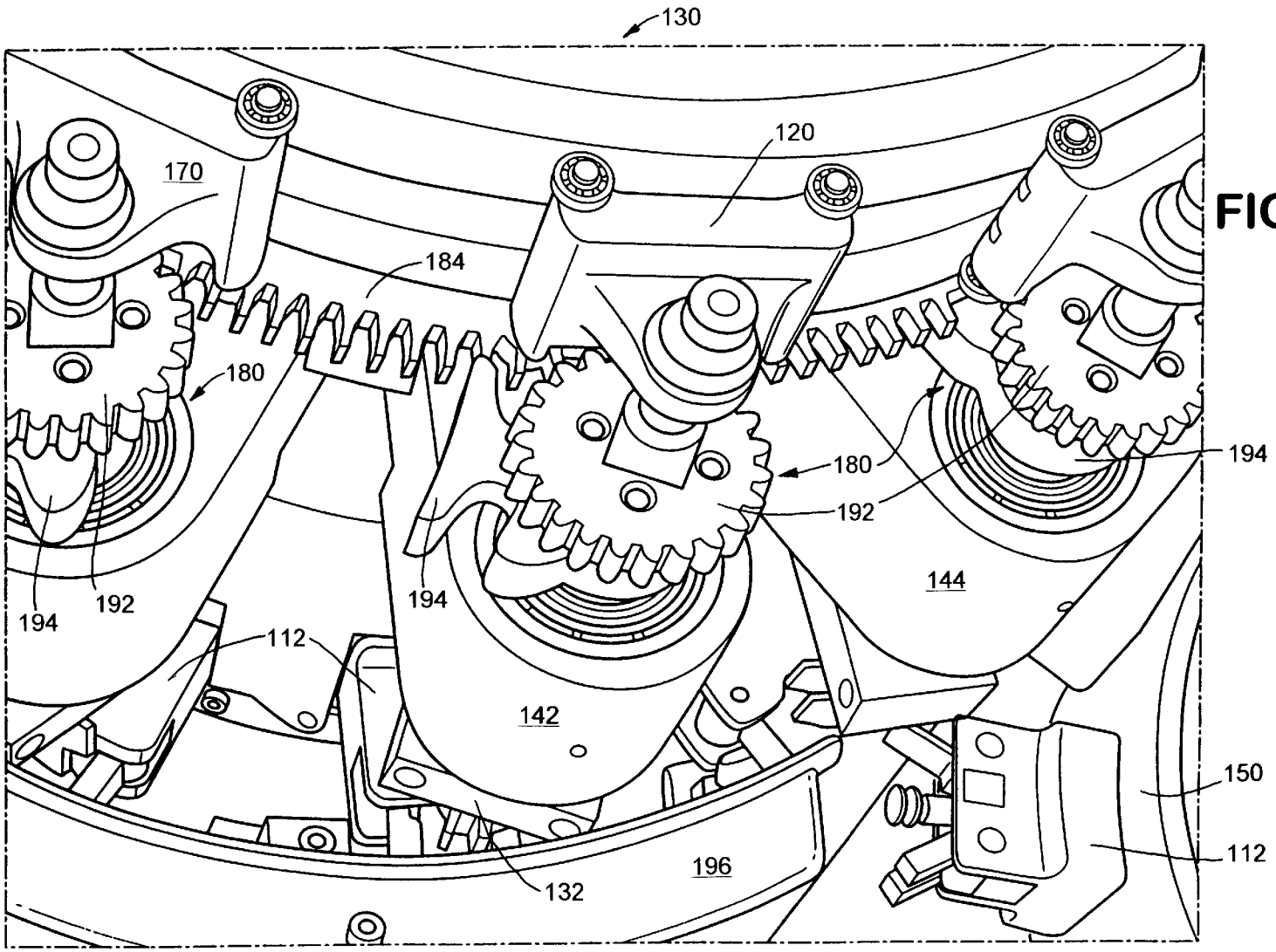
FIG. 11 shows additional details of the construction of the second drum of the preferred embodiment, and in particular shows the Geneva wheels used in that embodiment.
Figure 12:
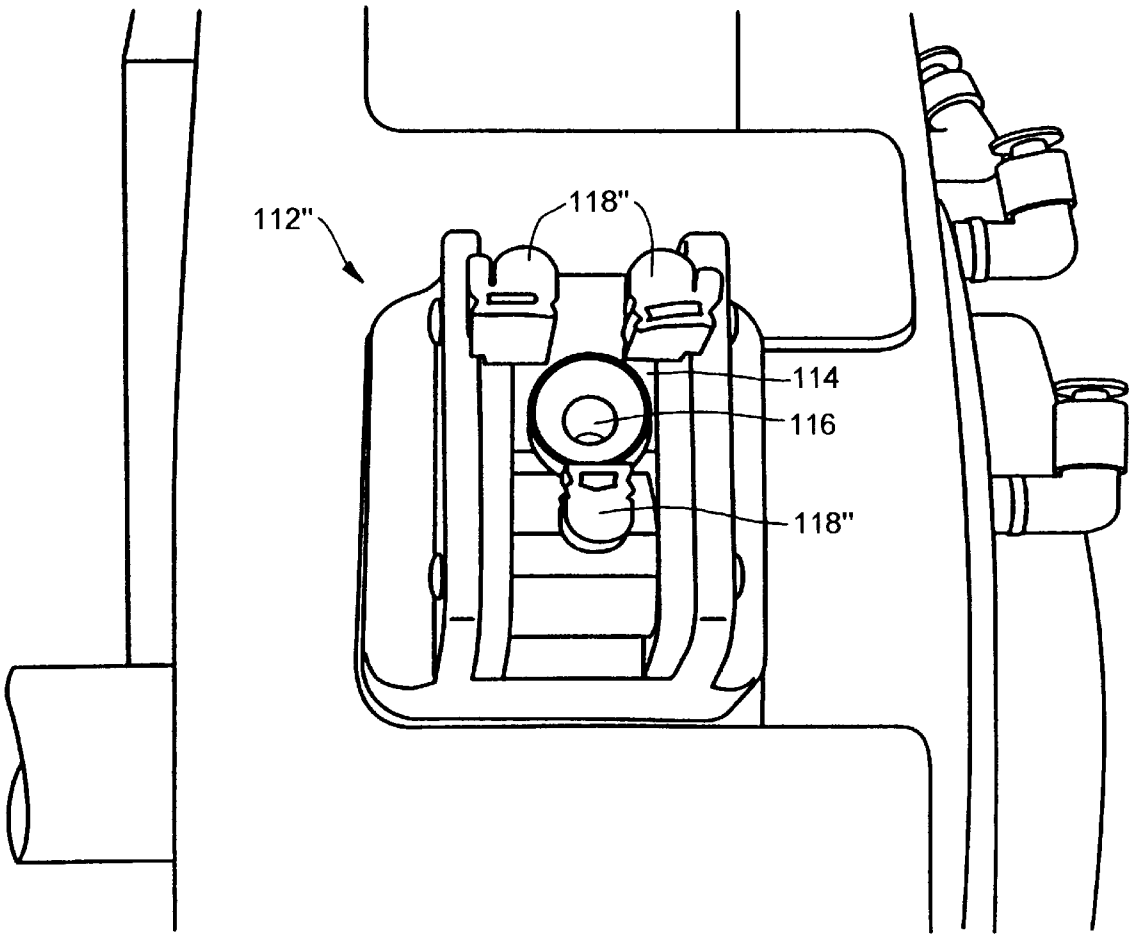
FIG. 12 shows one version of a product gripper, as used on all three drums of the preferred embodiment.

As shown in FIG. 5, the transfer-and-rotate drum 110 has twelve product grippers 112 provided on its circumference. The product gripper 112 comprises a base portion, or head, 114 whose upper surface contains vacuum tooling; that surface is shown as rectangular, but could be given any shape found advantageous in handling the particular product in question. One or more ports 116 (only one is shown) are provided in the upper surface of the head 114 of the product gripper 112 to permit the application of suction from the interior of the drum, to hold the product and the wrap securely against the product gripper 112. In the preferred embodiment, the product gripper 112 has three linear rods or fingers 118, two along one side and one on the opposing side of the head 114. These rods 118 are each movable between a closed position, in which they approach each other and thus grip and secure the product, in cooperation with the vacuum suction, and an open position, in which they are moved outward from each other and away from the product. Additional views of such product gripper 112' and 112" in place on one of the drums, are provided in FIGS. 10 and 12. These versions of the product gripper 112' and 112" differ in a number of details, such as the shape of fingers or rods 118' and 118", from the design shown in FIG. 5.

The lateral or circumferential surface of the transfer-and-rotate drum 110, on which the twelve product grippers 112 are mounted, is actually made up of twelve flat surfaces 120 of equal size, each carrying one of the product grippers 112. Each product gripper 112 is mounted such that it can be rotated on the flat surface 120 on which it is mounted, the rotation being about an axis passing through the product gripper 112 and through the axis of the transfer-and-rotate drum 110 itself.

Figure 7:
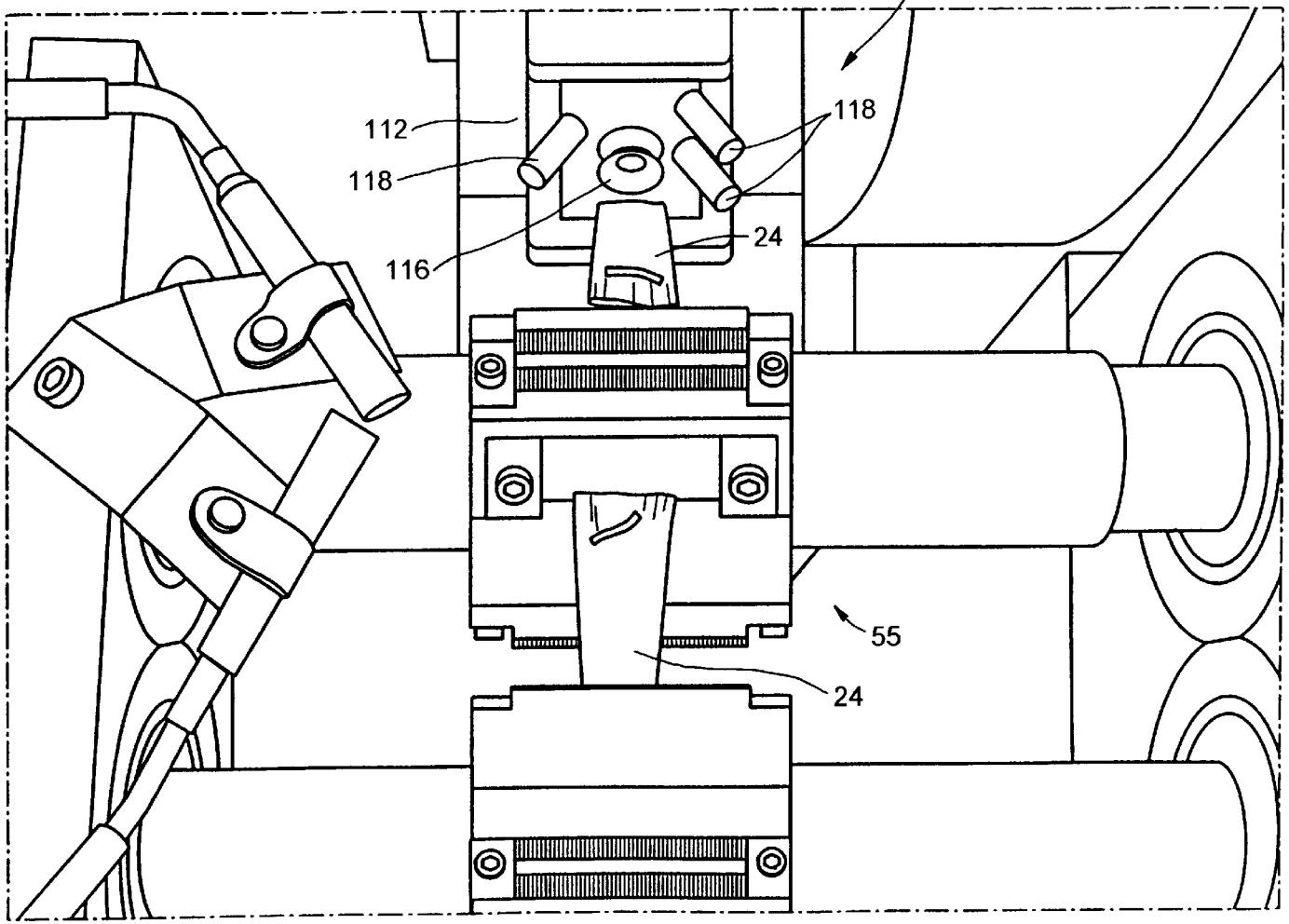
FIGS. 7–10 and 13 illustrate steps in the use of the preferred embodiment to produce a double twist-wrapped product like that shown in FIG. 3. More specifically.

As an empty product gripper 112 on the transfer-and-rotate drum 110 passes the upper arbor 55 of the cut-and-seal 50 (see FIGS. 7 and 8), the vacuum suction is actuated in that product gripper 112, while that holding the product 24 on the cut-and-seal upper arbor 55 is deactivated. This releases the product 24 from the cut-and-seal 50, and transfers it to the product gripper 112 on the transfer-and-rotate drum 110. The rods 118 on the product gripper 112 move to their closed position, holding and orienting the product 24 on the product gripper 112. As the drum 110 rotates about its axis to advance the product 24 toward the twist-wrap drum 130, the product gripper 112 itself is caused to rotate so as to reorient the product 24 (see FIGS. 8–10). In the preferred embodiment, the product gripper 112 is rotated through 90°, so that the open ends of the product "tube" 24 lie along a line parallel to the drum axis. This rotation of the product gripper is performed while the drum 110 has rotated through 240°. The product 24 is now in the proper place and orientation to be transferred to the twist-wrap drum 130.

The transfer to the twist-wrap drum 130 is performed by the rods 118 of the product gripper 112 being moved to their open position, and then the vacuum suction being deactivated, to release the product 24 onto an identical product gripper 112 on the twist-wrap drum 130. At the same time, vacuum suction is applied to the product 24 by the product gripper 112 that is receiving the product onto the twist-wrap drum 130, and the rods 118 of the receiving product gripper 112 are closed to secure the product 24, completing the transfer. (The remainder of the description of the operation of the twist-wrap drum 130 will be provided in the following section.) As the transfer-and-rotate drum 110 continues to rotate through the next 120°, the product gripper 112, now empty, is rotated back into its original orientation, so that it is ready to receive a product upon reaching the cut-and-seal 50 again.

The opening and closing of the rods 118 on the product grippers 112 is controlled by a face cam arrangement, while the rotation of the product grippers 112 to reorient the product is achieved by means of a barrel cam arrangement. Since these techniques are well understood in the art, they need not be described in detail.

The Twist-Wrap Drum

Figure 6:
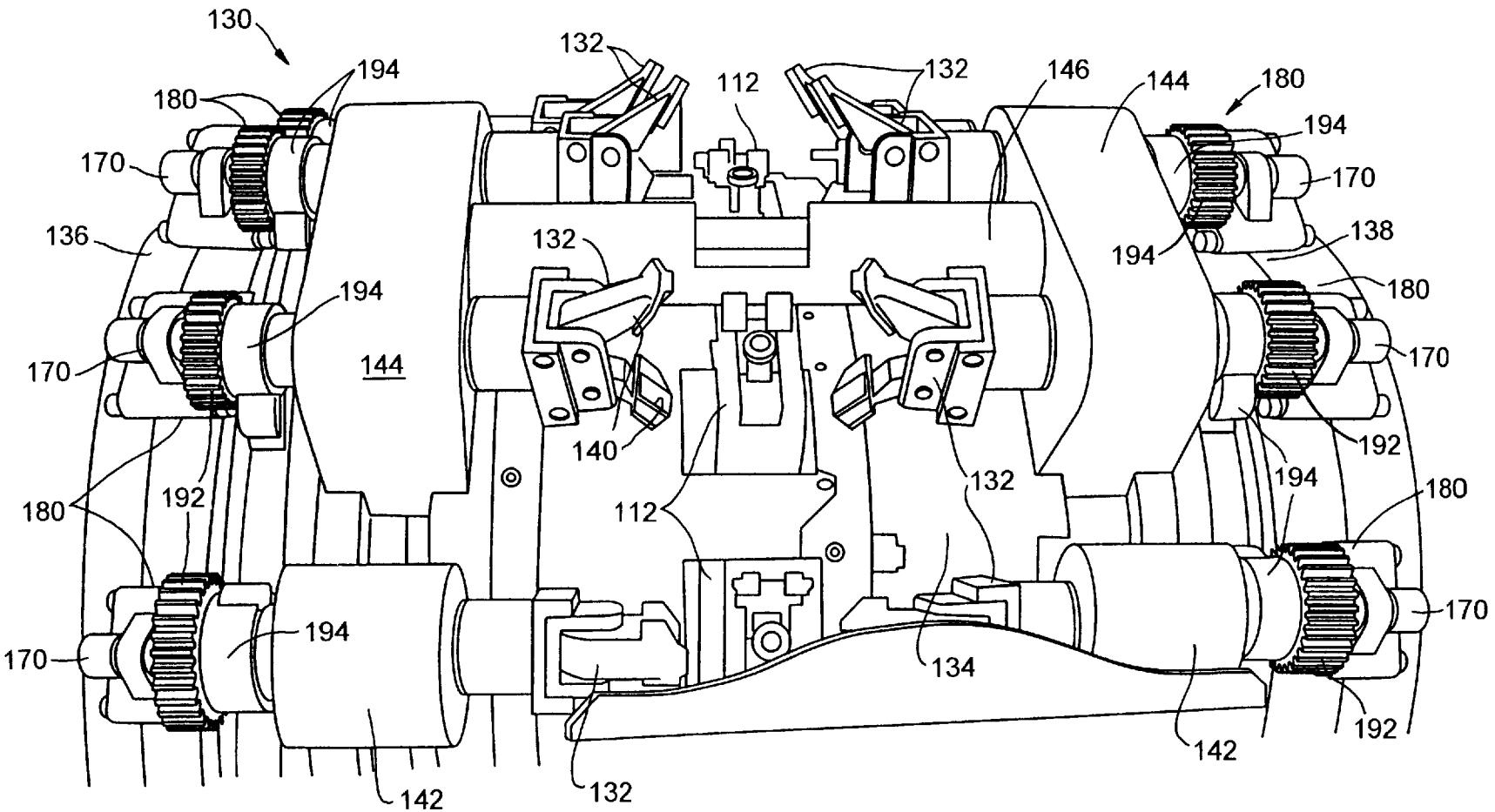
FIG. 6 illustrates a detail of the second drum of the embodiment shown in FIG. 5, and shows several sets of the twist grippers used to effect a double twist-wrap.

The twist-wrap drum 130, as is seen most clearly in FIG. 6, actually includes a center drum 134 disposed between an inner drum 136 and an outer drum 138, all three of which are driven to rotate at the same speed. The center drum 134 has on its lateral or circumferential surface twelve product grippers 112, which are identical to those of the transfer-and-rotate drum 110 but which cannot rotate about their own axes. As a result, the product remains in the same orientation all the time it is on the twist-wrap drum 130.

The inner and outer drums 136 and 138 each carry twelve twist grippers 132, one adjacent to each of the product grippers 112 on the center drum 134. Each twist gripper 132 has a pair of jaws 140, which can open and close, and are supported for rotation about the twist gripper's own axis (which is parallel to the axis of the twist-wrap drum 130). It will be noted that the housings 142 and 144 of the twist grippers 132 are not all the same, some containing one twist gripper 132, and some containing two each.

Moreover, posts 146 extend across the center drum 134 and connect these larger housings 144. The purpose of these double housings 144 and the posts 146 is to supply the drive force from the inner drum 136 to the outer drum 138, using techniques well-known in the art.

Figure 14A:
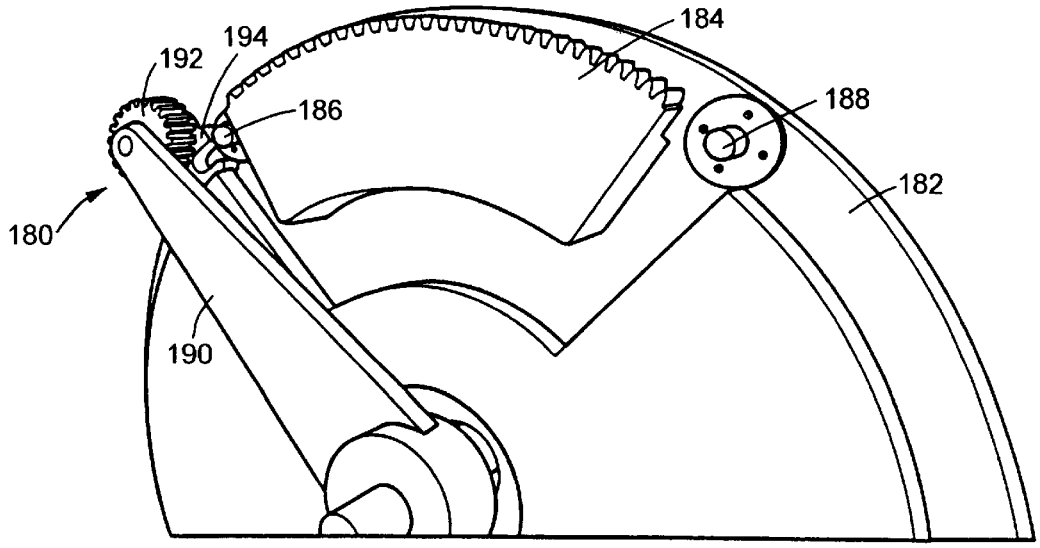
FIGS. 14A–14K are a sequence of views illustrating the operation of the Geneva wheels used in the preferred embodiment.
Figure 14B:
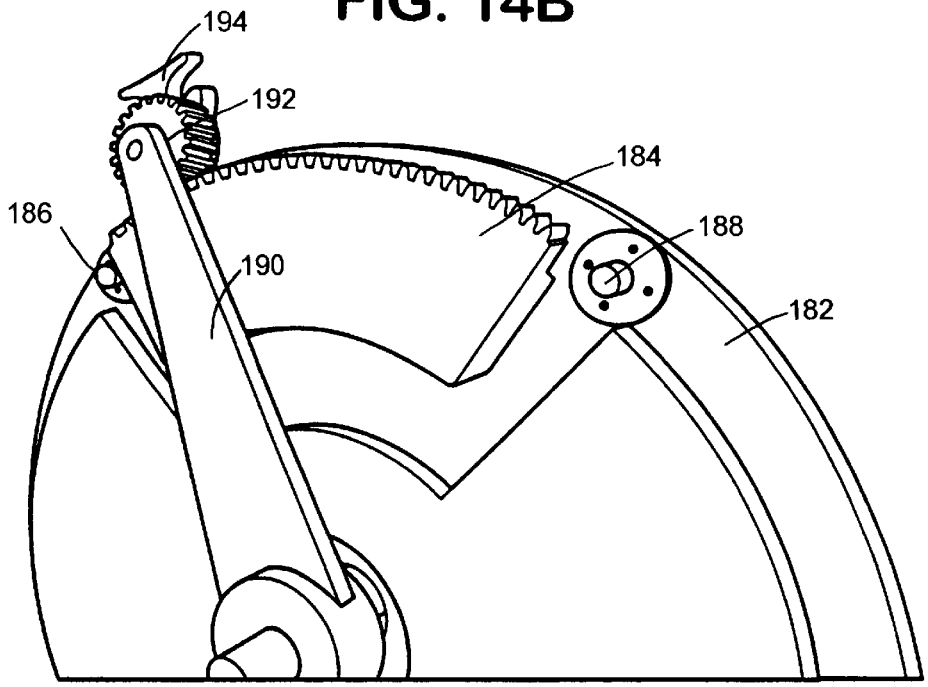
Figure 14C:
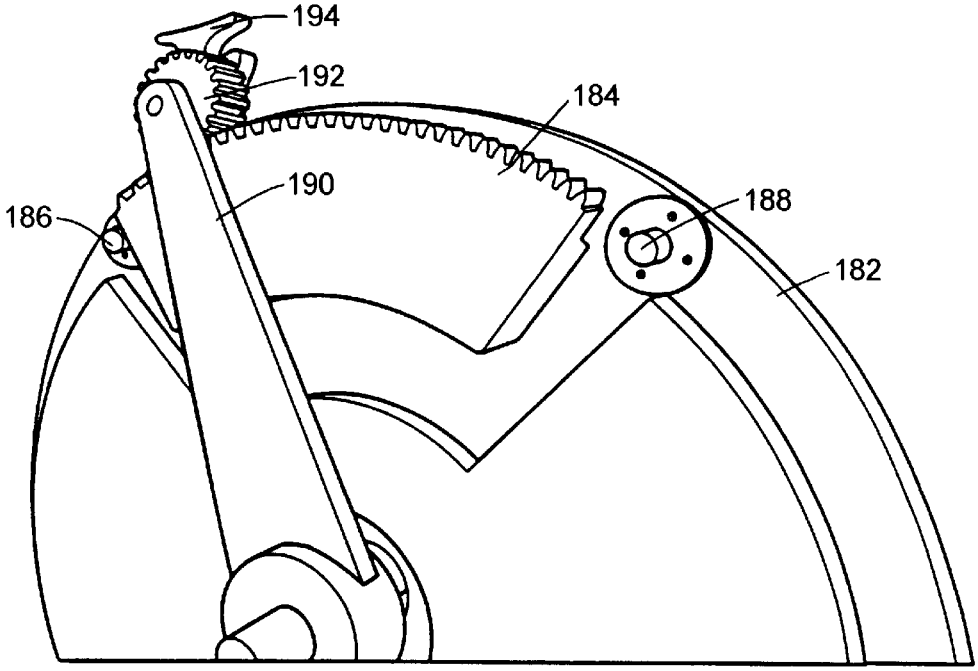
Figure 14D:
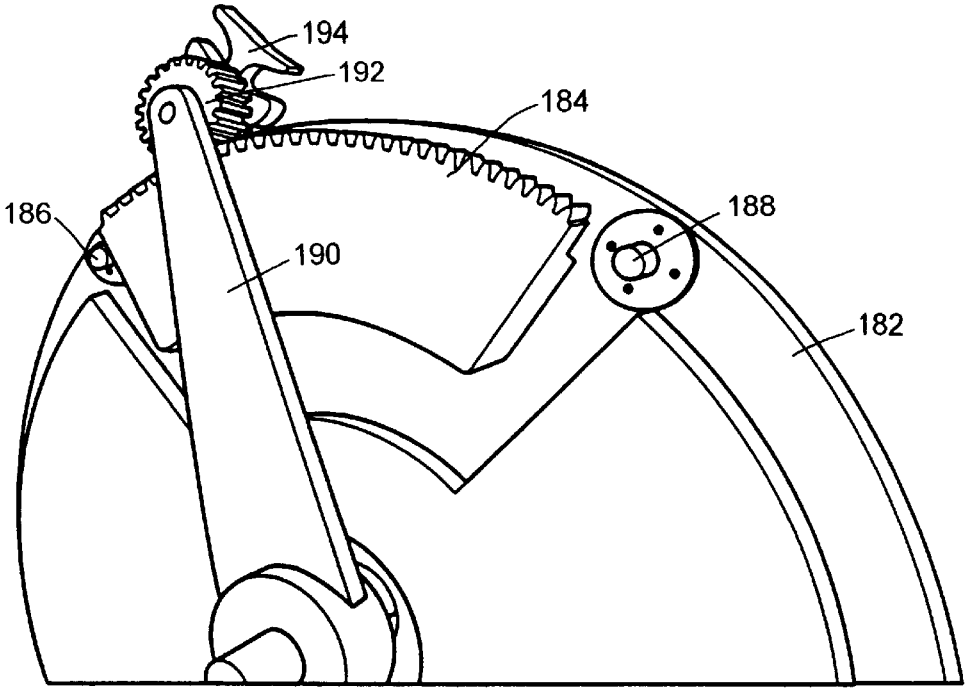
Figure 14E:
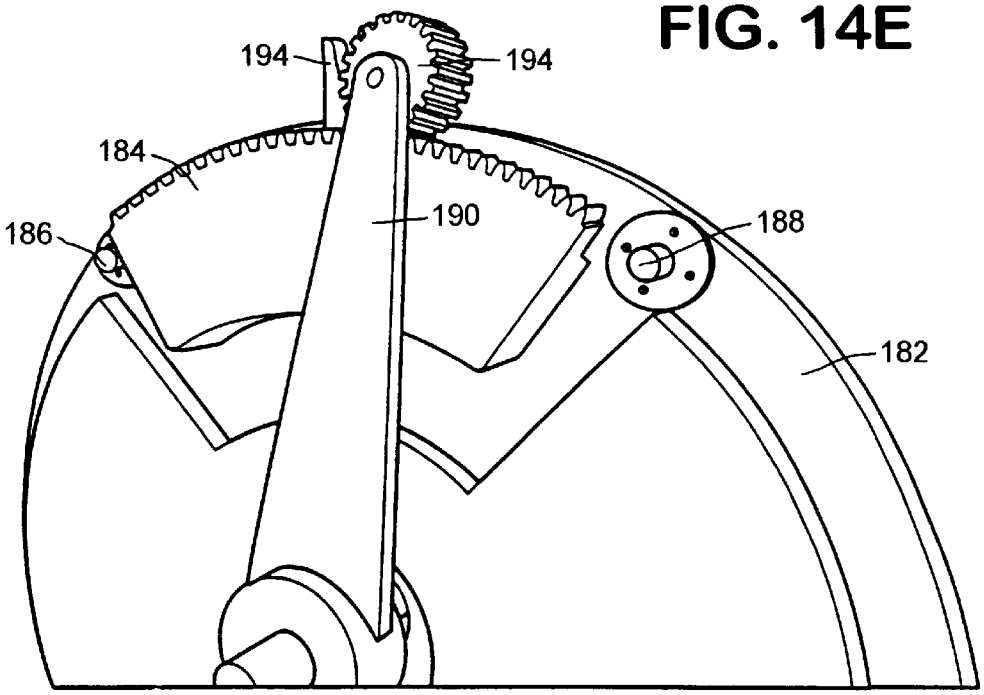
Figure 14F:
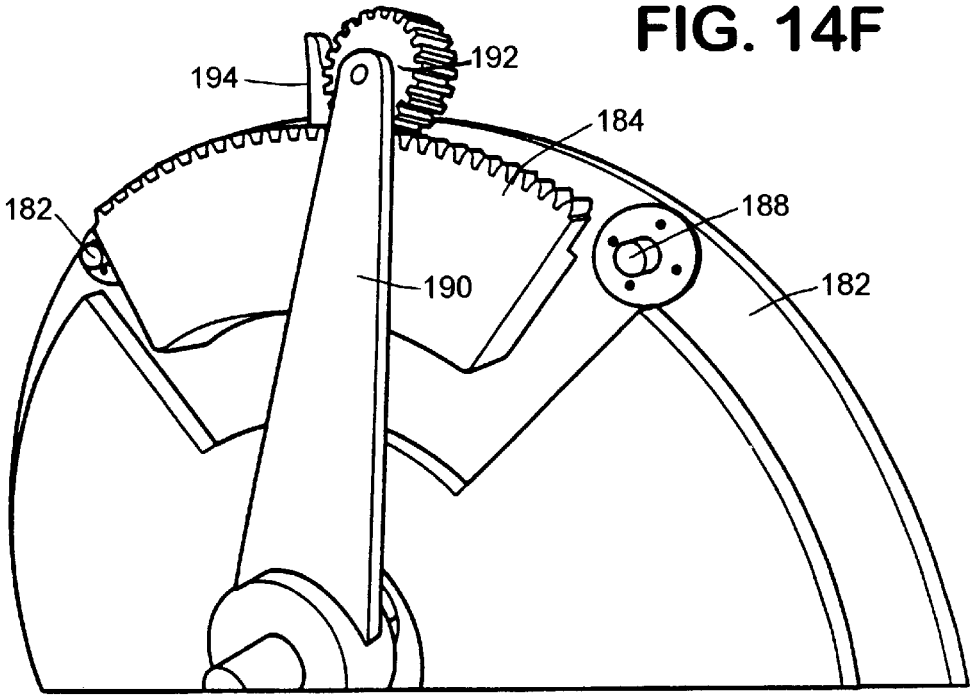
Figure 14G:
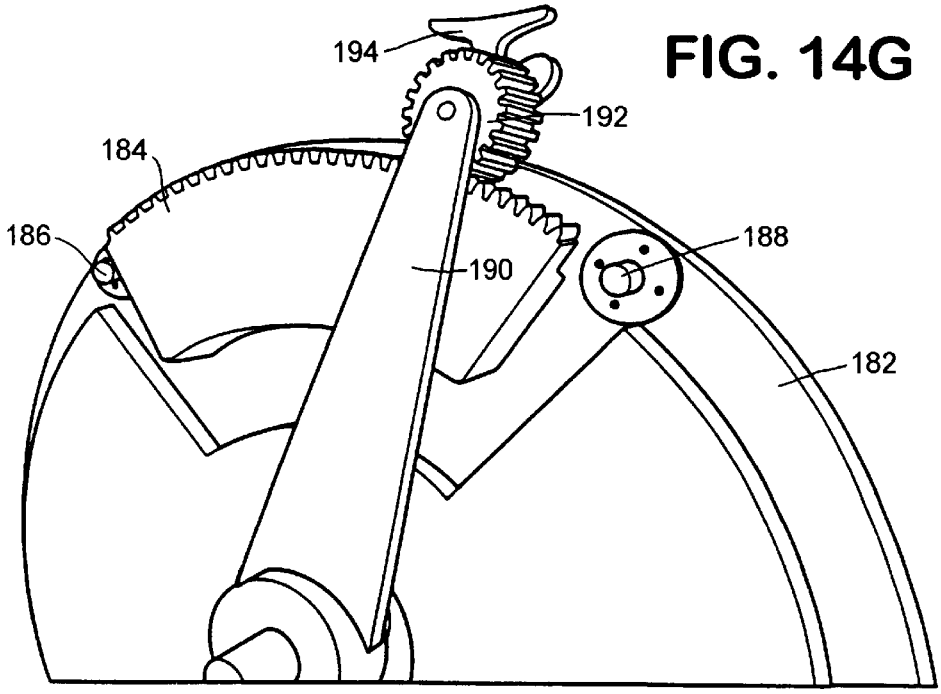
Figure 14H:
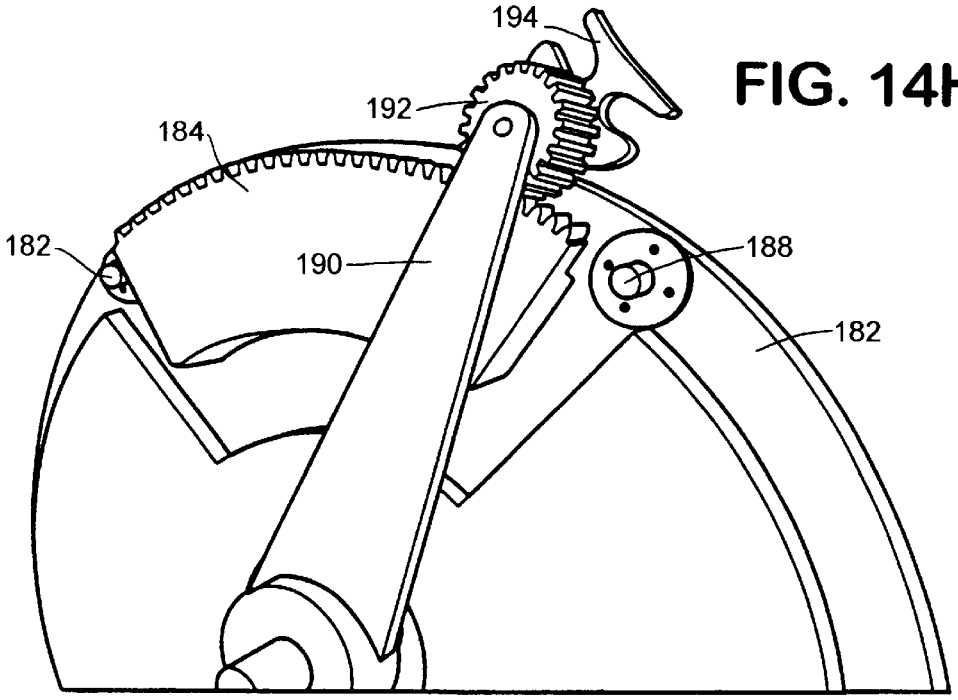
Figure 14I:
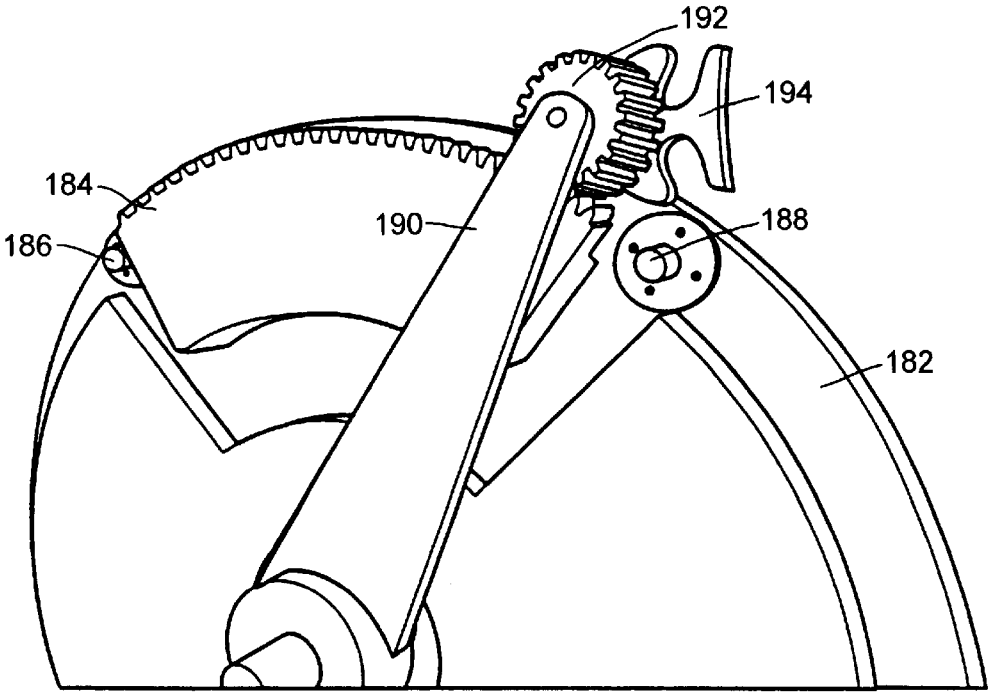
Figure 14J:
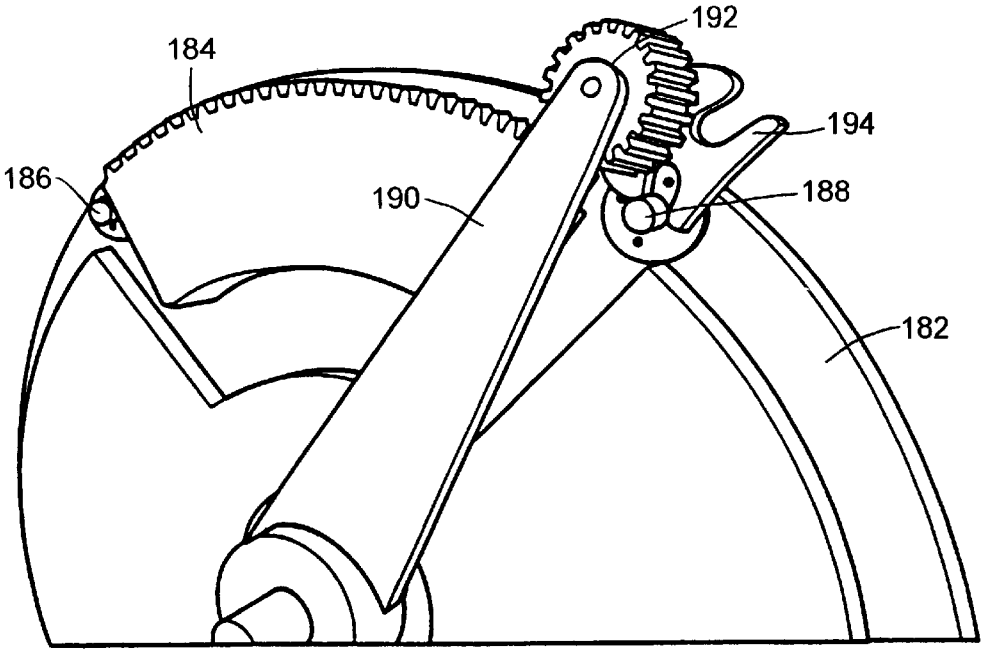
Figure 14K:
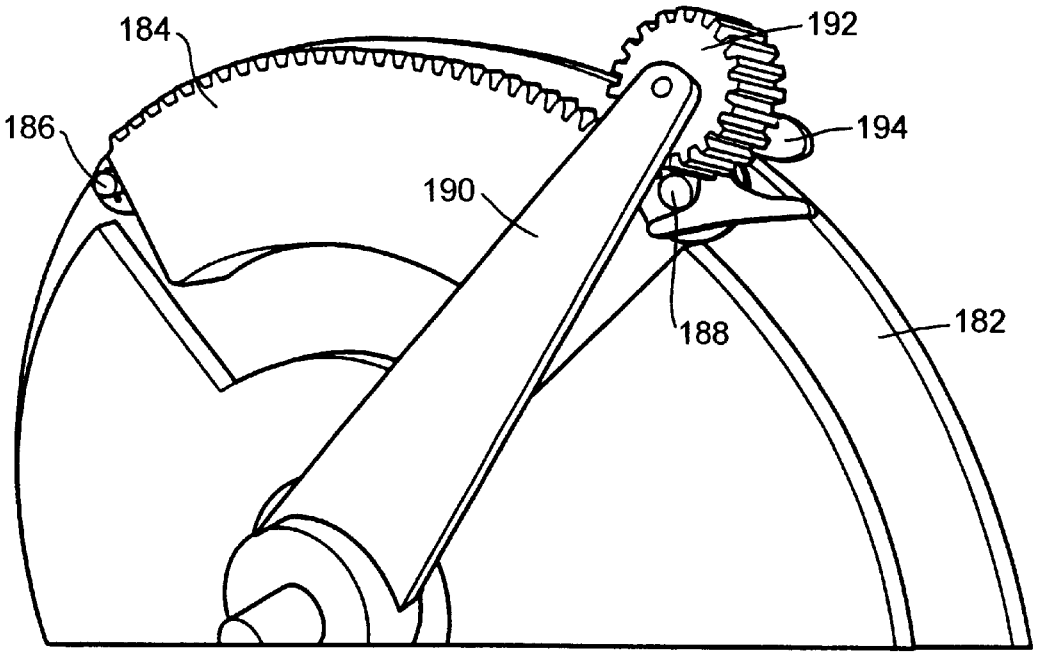

In the preferred embodiment, the twist grippers 132 do not rotate at all times, but only the amount and at the times necessary to achieve the desired twist-wraps. For this purpose, they are driven by Geneva wheel mechanisms 180 shown in detail in FIGS. 11 and 14A–14K. One such mechanism is provided for each of the 24 twist grippers 132, and is located at one end of the associated twist gripper 132. In addition, the inner and outer drums 136 and 138 each have a respective disc 182 (see FIG. 14A) on which is mounted a radial gear rack 184, together with two pins, an acceleration pin 186 and a deceleration pin 188, which are respectively at the beginning and the end of the radial gear rack 184. These two discs 182 are stationary during rotation of the twist-wrap drum 130. Each Geneva wheel mechanism 180 is provided with a mounting 170 that carries the Geneva wheel mechanism 180 smoothly on the surface of the drum 136 or 138.

Figure 13:
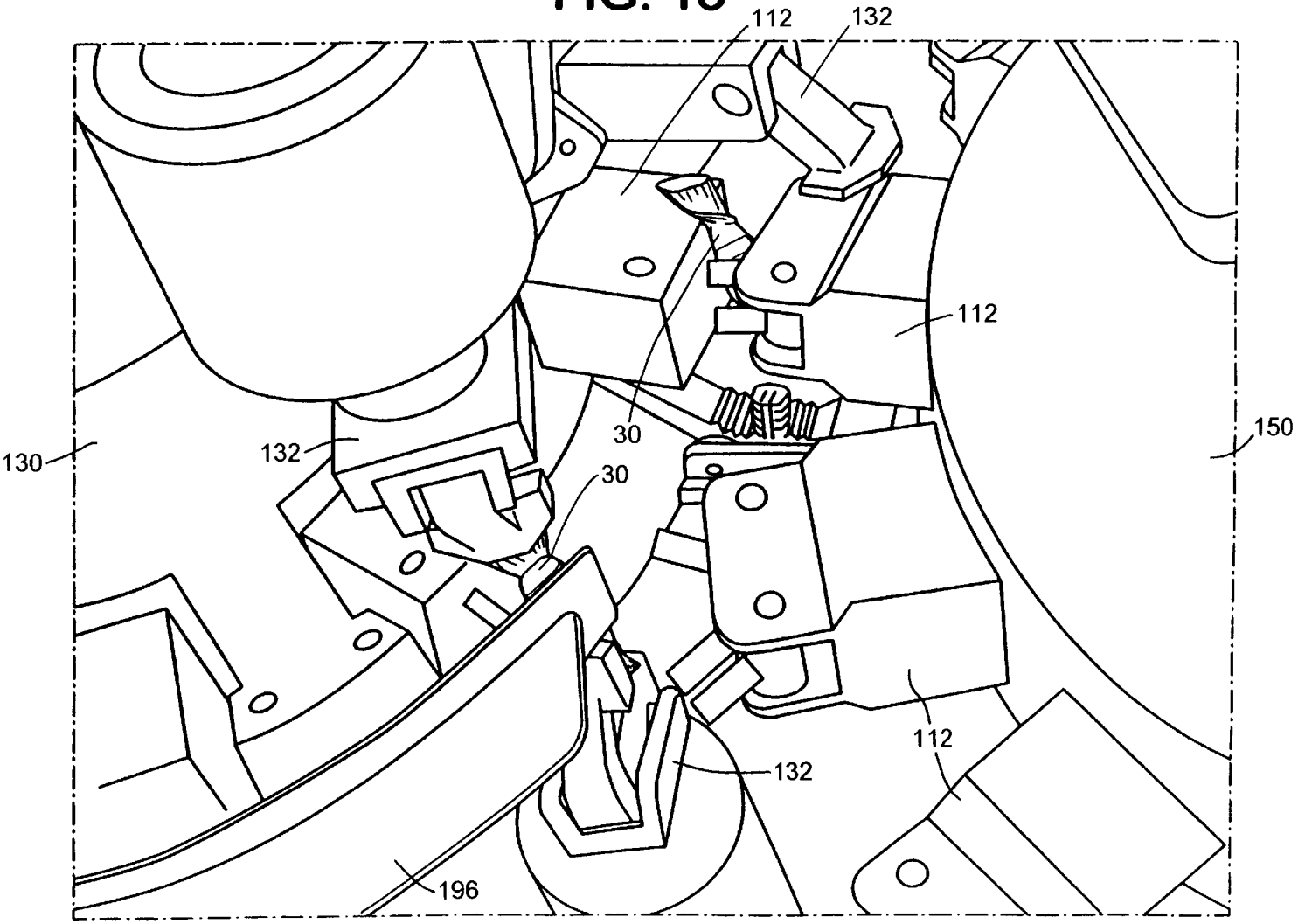

Mounted coaxially with the disc 182 is a rotatable arm 190 for each of the twist grippers 132, at the radially-outer end of which is a small gear wheel 192, which in operation rides along and in engagement with the radial gear rack 184. A cam path 194 is secured to the gear wheel 192, and is caused to rotate as the gear wheel 192 moves along the radial gear rack 184. These cam paths each have portions that are to engage the acceleration and deceleration pins 186 and 188, respectively. During rotation of the twist-wrap drum 130, each of the cam paths 194 in turn come into engagement with the acceleration pin 186, and the associated gear wheel 192 then engages and rides along the gear rack 184 to drive the twist gripper 132, rotating the latter through 720°, thus twisting the end of the product "wrap" and forming the twist-wrap. The formation of the twist-wrap is assisted by an arcuate plate 196 (shown in FIGS. 11 and 13), which helps hold the product in place against the product gripper 112 as the twist grippers 132 twist.

In operation, when the product gripper 112 on the twist-wrap drum 130 has secured the product 24 from the transfer-and-rotate drum 110, the twist grippers 132 adjacent to that product gripper 112 are moved to the closed position, gripping the ends of the product "wrap". After the twist-wrap has been formed, the twist grippers 132 open, and the twist-wrapped product 30 is ready to be transferred to the discharge drum 150. The opening and closing of the twist grippers 132 is achieved by a barrel cam. The timing of this is controlled by the indexing of the Geneva wheel 180 itself, thus guaranteeing that the twist grippers 132 will engage and securely grip the product "wrap" before the twisting begins. Again, the further details of these cam arrangements are within the ordinary level of knowledge of those in the art, and need not be described further.

The Discharge Drum

The discharge drum 150 is provided with twelve product grippers 112 identical to those of the other two drums 110 and 130 (but, unlike those of the transfer-and-rotate drum 110, not themselves mounted for rotation). The transfer of the product 30 from the twist-wrap drum 130 to the discharge drum 150 is achieved in the same manner as that from the transfer-and-rotate drum 110 to the twist-wrap drum 130, and therefore will not be described in detail.

The present invention has been described by reference to the preferred embodiment thereof, including enough detail to enable those of ordinary skill to make and practice the invention, and including what the inventors currently consider to be their best mode (if any) of practicing the invention. Nonetheless, many modifications and variations will now be apparent to those skilled in the art, and the scope of the present invention is therefore not to be limited by the details of the foregoing description, but only by the terms of the following claims.

What is claimed is:

1. A flow-wrap packaging line for wrapping a series of individual articles, comprising:

a flow-wrap machine, comprising:

a first section, in which a film is formed into a tubular wrap about the articles; and a cut-and-seal section, in which the tubular wrap is cut between each two successive articles, said cut-and-seal section being operable in a first mode, in which the tubular wrap is also sealed, thereby completing wrapping of the articles, and in a second mode, in which the tubular wrap is cut but not sealed; and a special-wrap machine, attachable to and detachable from said cut-and-seal section of said flow-wrap machine, and comprising:

a receiving portion, constructed and arranged such that, when said special-wrap machine is attached to said cut-and-seal section, said receiving portion receives a tube-wrapped article into a predetermined location, from said cut-and-seal section, and said special-wrap machine comprising a special-wrap assembly having at least one set of elements adapted to form a special wrap in the tube-wrapped article, and a control unit for operating said attached special-wrap assembly when said cut-and-seal station operates in said second mode.

2. A packaging line according to claim 1, wherein said detachable special-wrap machine is a detachable twist-wrap machine, and said special-wrap assembly is a twist-wrap assembly having rotatable grippers to grip ends of the tube-wrapped article, and to twist the ends to form a twist-wrapped article.

3. A packaging line according to claim 2, further comprising a control signal generator unit that generates control signals to control operation of said machines of said packaging line, said control signals including a registration signal and an encoder signal, and wherein said twist-wrap machine has signal lines connectable to receive said registration signal and said encoder signal.

4. An apparatus according to claim 1, wherein said transfer-and-rotate assembly includes a drum rotatable about a first drum axis, at least one product gripper mounted on a peripheral surface of said drum, said product gripper being rotatable about a second axis perpendicular to said first drum axis, and a drive assembly that rotates said product gripper 90° about said second axis while said drum rotates about said first drum axis.

5. An apparatus according to claim 2, wherein said twist-wrap assembly includes a twist-wrap drum and includes Geneva wheels that drive said twist grippers.

6. An apparatus according to claim 5, wherein said Geneva wheels cause said twist grippers to begin rotating immediately after said twist grippers have gripped the partially-wrapped article, and cause said twist grippers to continue to rotate through a predetermined angle, sufficient to effect a twist-wrap, and then to stop.

7. An apparatus according to claim 5, wherein said twist grippers close on the partially-wrapped article as the partially-wrapped article is received at said predetermined location, and open to release the twist-wrapped article as the twist-wrapped article is transferred from said twist-wrap assembly.

8. An apparatus according to claim 7, further comprising a discharge drum that is located to receive the twist-wrapped article from said twist-wrap assembly as the twist-wrapped article is released by said twist-wrap assembly.

* * * * *

UNITED STATES PATENT AND TRADEMARK OFFICE

CERTIFICATE OF CORRECTION

PATENT NO. : 6,539,687 B1
DATED : April 1, 2003
INVENTOR(S) : Bruce W. Keen et al.

It is certified that error appears in the above-identified patent and that said Letters Patent is hereby corrected as shown below:

Title page,
Item [57], ABSTRACT,
Line 19, "A" should be deleted.

Column 8,
Line 2 "station" should read -- section --.
Lines 16, 23, 26, 32 and 38, "An apparatus" should read -- A packaging line --.

Signed and Sealed this

Eighth Day of June, 2004

JON W. DUDAS
*Acting Director of the United States Patent and Trademark Office*